US006369786B1

(12) United States Patent
Suzuki

(10) Patent No.: US 6,369,786 B1
(45) Date of Patent: Apr. 9, 2002

(54) MATRIX DRIVING METHOD AND APPARATUS FOR CURRENT-DRIVEN DISPLAY ELEMENTS

(75) Inventor: Yoshio Suzuki, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/300,466

(22) Filed: Apr. 28, 1999

(30) Foreign Application Priority Data

Apr. 30, 1998 (JP) ..... P10-121221

(51) Int. Cl.[7] ..... G09G 3/30
(52) U.S. Cl. ..... 345/77; 345/78; 345/82
(58) Field of Search ..... 345/55, 92, 145, 345/76, 77, 78, 79, 80, 81, 82, 83

(56) References Cited

U.S. PATENT DOCUMENTS 5,325,107 A * 6/1994 Ogawa et al. ..... 345/79
5,517,207 A * 5/1996 Kawada et al. ..... 345/78
5,670,792 A * 9/1997 Utsugi et al. ..... 257/59
5,896,114 A * 4/1999 Imamura et al. ..... 345/55
6,115,017 A * 9/2000 Mikami et al. ..... 345/92

* cited by examiner

*Primary Examiner*—Steven Saras
*Assistant Examiner*—Uchendu O. Anyaso
(74) *Attorney, Agent, or Firm*—Rader, Fishman & Grauer PLLC; Ronald P. Kananen

(57) ABSTRACT

Current-driven display elements are disposed in the form of a matrix at each of intersections of a plurality of scanning electrodes ScE ($ScE_1$, $ScE_2$, . . . , $ScE_y$) and a plurality of signal electrodes SiE ($SiE_1$, $SiE_2$, . . . , $SiE_x$), a scanning electrode ScE is selected and a display signal is supplied to the signal electrode SiE, to drive each current-driven display element. Means for precharging an electric charge for a capacity of the intersections before supplying the display signal to the signal electrodes SiE, thereby suppressing the influence of a stray capacitance developed at the intersections of the scanning and signal electrodes.

8 Claims, 7 Drawing Sheets

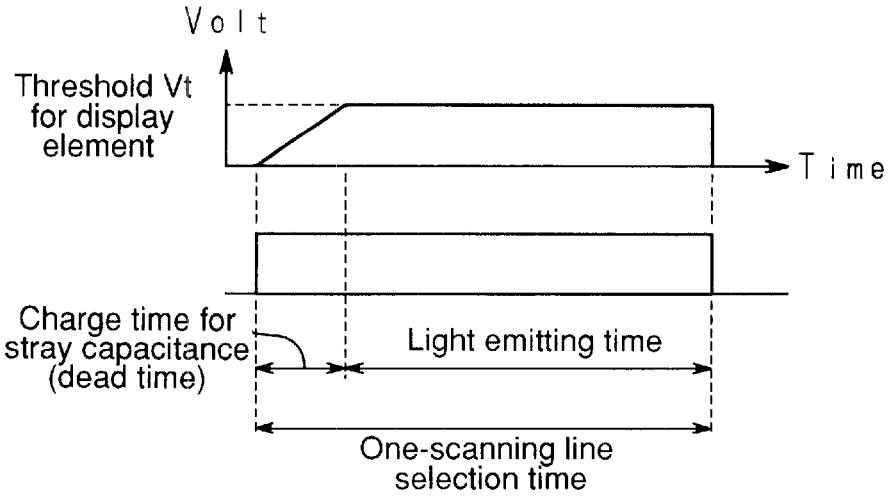
FIG.2
FIG.3A
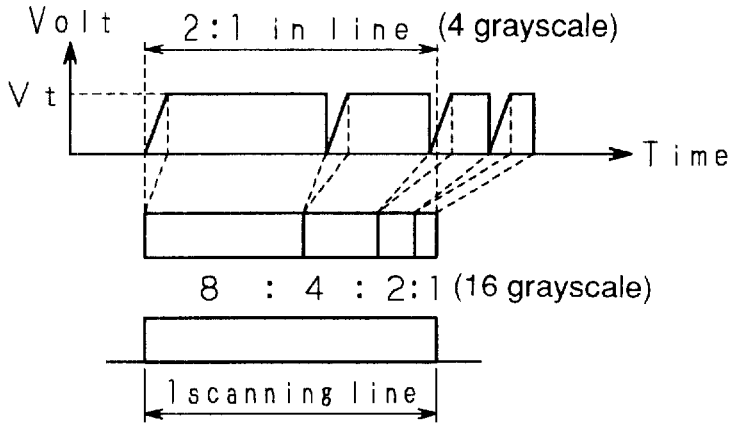
FIG.3B
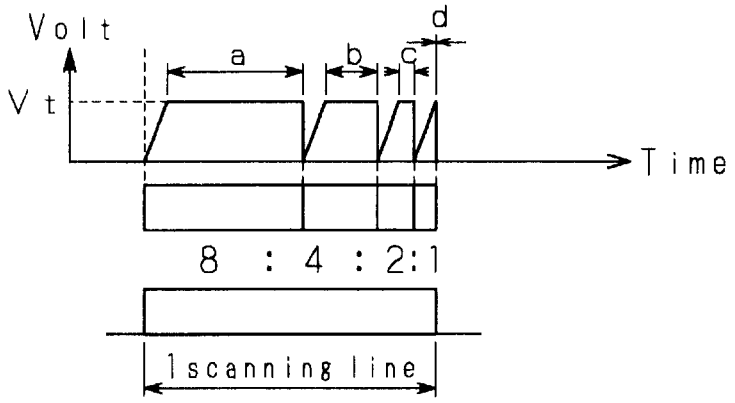

MATRIX DRIVING METHOD AND APPARATUS FOR CURRENT-DRIVEN DISPLAY ELEMENTS

BACKGROUND OF THE INVENTION

1. Field of the Invention

The present invention relates to a matrix driving method and apparatus for current-driven display elements such as LED (light emitting diode), ECD (electrochromic display), EL (electroluminescence), and so forth.

2. Description of Related Art

A simple X-Y matrix drive for display elements (will be referred to simply as "matrix drive" hereinunder) has two stripe electrode groups comprising a plurality of scanning electrodes and a plurality of signal electrodes, respectively, disposed perpendicular to each other, and drive circuits connected to the stripe electrodes, respectively, to change a voltage or the like at the intersections, thereby driving display elements disposed at the intersections, respectively.

The matrix drive uses a driving method depending upon a relationship between an input (voltage or current) to the matrix drive and an output from the display element (light intensity, transmittance or reflectance). That is, in case the display element is a liquid crystal, for example, the matrix drive adopts a line-sequential scanning method in which scanning electrodes are selected in a line-sequence, to change the effective voltage applied to the liquid crystal (if the liquid crystal is a TNLC (twisted-nematic liquid crystal) or the voltage polarity (if the liquid crystal is a FLC (ferroelectric liquid crystal)).

On the other hand, current-driven display elements such as LED (light emitting diode), ECD (electrochromic display), EL (electroluminescence), and so forth are driven by a matrix drive shown by way of example in FIG. 1. The matrix drive is generally indicated with a reference 100. As shown in FIG. 1, the matrix drive 100 comprises a set of scanning electrodes ScE ($ScE_1$, $ScE_2$, . . . , $ScE_y$) and a set of signal electrodes SiE ($SiE_1$, $SiE_2$, . . . , $SiE_x$), disposed perpendicular to each other. The above-mentioned current-driven display elements are disposed at intersections of the stripe electrodes in these two sets. The matrix drive 100 further comprises a scanning electrode drive circuit 101 connected to the scanning electrodes ScE and a signal electrode drive circuit 102 connected to the signal electrodes SiE.

As shown in FIG. 1, the scanning electrode drive circuit 101 comprises select switches L ($L_1$, $L_2$, . . . , $L_y$) connected to the scanning electrodes $ScE_1$, $ScE_2$, . . . , $ScE_y$, respectively. The potential at a selected scanning electrode ScE is dropped to the ground potential (GND) level by turning on or off each of the select switches L by a control signal from a controller (not shown).

On the other hand, the signal electrode drive circuit 102 comprises select switches S ($S_1$, $S_2$, . . . , $S_x$) connected to the signal electrodes $SiE_1$, $SiE_2$, . . . , $SiE_x$), respectively, and current sources CS ($CS_1$, $CS_2$, . . . , $CS_x$) connected to the select switches S, respectively, and also to a power source 103. By turning on or off the select switches S by a control signal from a controller (not shown), a current is supplied as a display signal to a selected one of the signal electrodes SiE from the current source CS. Thus, as the select switches L and S are turned on or off, the matrix drive 100 line-sequentially drives the current-driven display elements disposed at the intersections of selected scanning electrodes ScE and selected signal electrodes SiE.

In the matrix drive 100, however, there develops a capacitance called "stray capacitance" at the intersection of the scanning and signal electrodes ScE and SiE, which causes the following problems.

That is, in the matrix drive 100, when a current (i.e. a display signal) is supplied to the current-driven display elements from the current source CS for line-sequential drive of the display elements, an electric charge will be charged for the stray capacitance. Thus, in the matrix drive 100, a current dedicating to the display does not flow until a threshold voltage Vt required for display (i.e., light emission) of the current-driven display element is reached, so that a "dead time" will arise for a time during which one scanning line is selected, as shown in FIG. 2. Therefore, because of the dead time, the matrix drive 100 cannot provide any efficient display for the time for selection of one scanning line. The luminance of the current-driven display element will decrease at this time by a light emitting time/one-scanning line selection time×100 (%) as will also been seen from FIG. 2.

In the matrix drive 100, the dead time will have a remarkable influence on a gray-scale representation among others. When gray scales are represented at a pulse width ratio of 8:4:2:1, for example, by PWM (pulse width modulation) in the matrix drive 100, the number of gray scales is limited or image quality is deteriorated as shown in FIG. 3 since one scanning line has to be selected for a predetermined time. More specifically, in the matrix drive 100, when a gray scale representation is done within the one scanning line selection time to maintain the pulse width ratio of 8:4:2:1 taking the above-mentioned dead time in consideration, 16 gray scales are reduced to 4 ones, for example, as shown in FIG. 3A, namely, the number of gray scales is insufficient. On the other hand, a gray scale representation is done at the pulse width ratio of 8:4:2:1 by a line-sequential drive taking no account of the dead time, a ratio of 8:4:2:1 in light emitting time cannot correctly be ensured for display times a, b, c and d as shown in FIG. 3B, so that a non-linearization, gamma deterioration, of gray scales will take place and thus gray scale representation cannot correctly be done.

SUMMARY OF THE INVENTION

Accordingly, the present invention has an object to overcome the above-mentioned drawbacks of the prior art by providing a matrix driving method and apparatus for current-driven display elements, adapted to suppress the influence of a stray capacitance taking place at intersections of scanning and signal electrodes.

The above object can be attained by providing a matrix driving method for current-driven display elements, in which current-driven display elements are disposed, in a matrix fashion, at intersections of a plurality of scanning electrodes and a plurality of signal electrodes, a scanning electrode is selected and a display signal is supplied to each signal electrode to drive each of the current-driven display elements, wherein according to the present invention:

an electric charge is precharged for a capacity of the intersection before the display signal is supplied to the signal electrode.

In the current-driven display element matrix driving method, an electric charge is precharged for the capacity of the intersections, whereby an electric charge is accumulated for the stray capacitance developed at the intersections of the scanning and signal electrodes.

Also, the object can be attained by providing a matrix driving apparatus for current-driven display elements, in which current-driven display elements are disposed, in a matrix fashion, at intersections of a plurality of scanning electrodes and a plurality of signal electrodes, a scanning electrode is selected and a display signal is supplied to each signal electrode to drive each of the current-driven display elements, the matrix driving apparatus comprising, according to the present invention:

means for precharging an electric charge for a capacity of the intersection before the display signal is supplied to the signal electrode.

In the current-driven display element matrix driving apparatus, the precharging means precharges an electric charge for the capacity of the intersections, thereby accumulating an electric charge for the stray capacitance developed at the intersections of the scanning and signal electrodes.

These objects and other objects, features and advantages of the present intention will become more apparent from the following detailed description of the preferred embodiments of the present invention when taken in conjunction with the accompanying drawings.

BRIEF DESCRIPTION OF THE DRAWINGS

FIG. 2 shows a relationship between a one-scanning line selection time and light emitting time;

FIG. 3 explains an image quality deterioration due to a dead time, of which FIG. 3A shows a decrease of number of gray scales, and FIG. 3B shows a deterioration of the gamma characteristic;

DETAILED DESCRIPTION OF THE PREFERRED EMBODIMENTS

Figure 1:
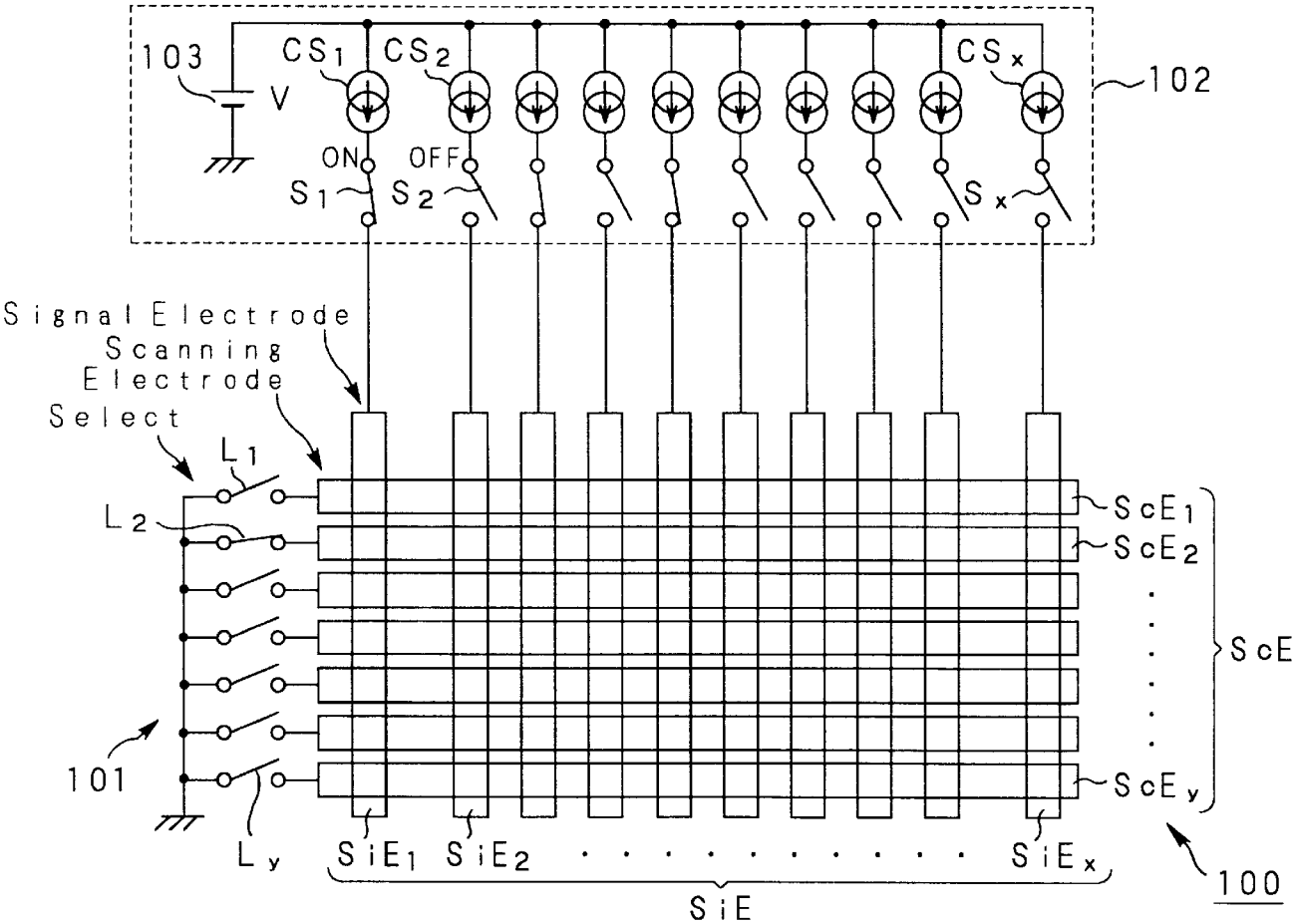
FIG. 1 is a schematic illustration of a conventional current-driven display element driving apparatus.
Figure 4:
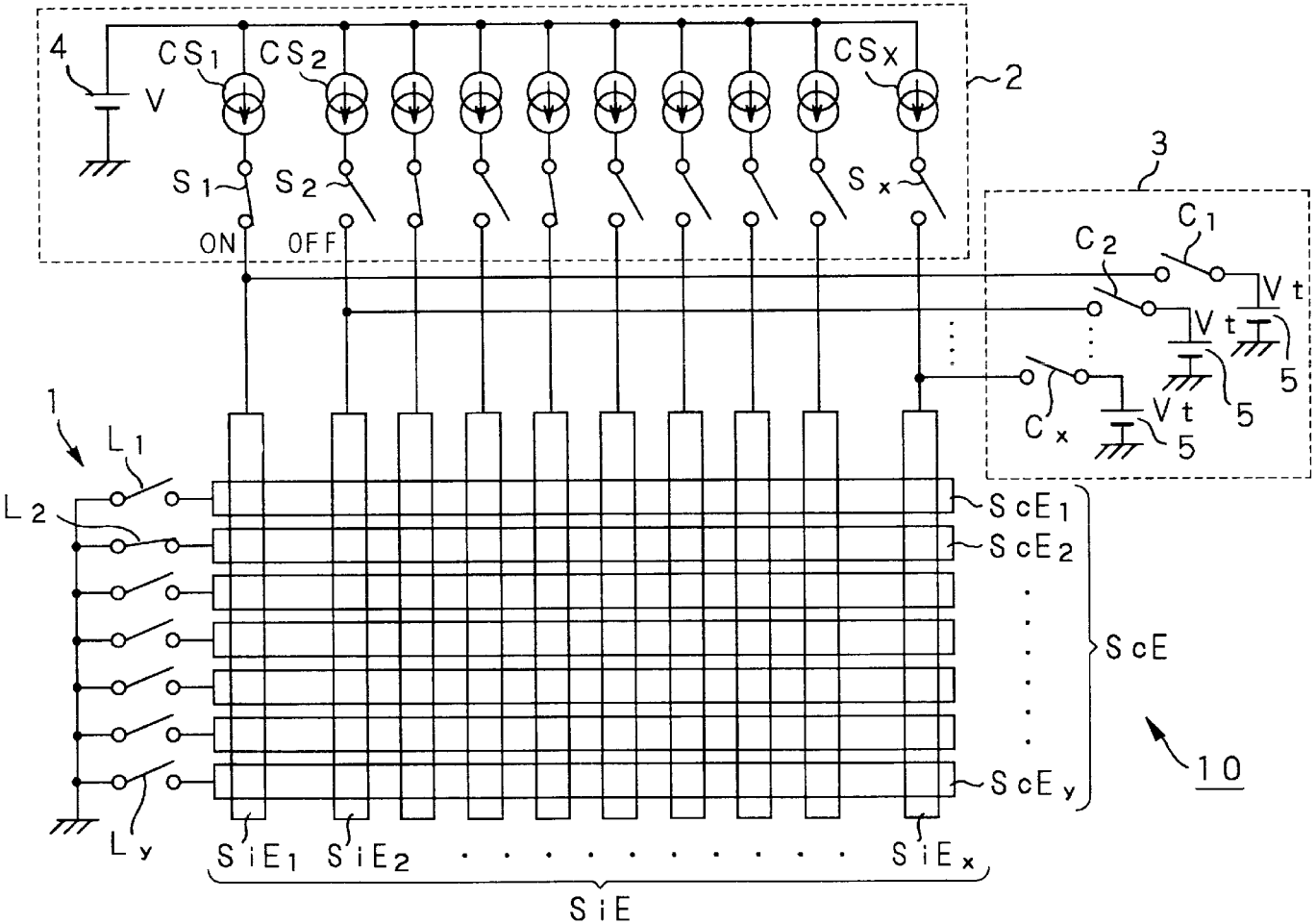
FIG. 4 is a schematic illustration of an embodiment of the current-driven display element matrix driving apparatus according to the present invention.

Referring now to FIG. 4, there is illustrated the first embodiment of the simple matrix driving apparatus for driving current-driven display elements (referred to simply as "matrix drive" hereinunder) according to the present invention. The matrix drive is generally indicated with a reference 10. The matrix drive 10 comprises a plurality of scanning electrodes ScE ($ScE_1$, $ScE_2$, . . . , $ScE_y$) and a plurality of signal electrodes SiE ($SiE_1$, $SiE_2$, . . . , $SiE_x$), disposed perpendicular to each other, current-driven display elements disposed at intersections of the two sets of electrodes, a scanning electrode drive circuit 1 connected to the scanning electrodes ScE, a signal electrode drive circuit 2 and precharge circuit 3, connected to the signal electrodes SiE.

In the matrix drive 10, the scanning electrodes ScE are formed each from a metal in the form of a stripe and serve as cathodes, while the signal electrodes are formed each from a transparent member also the form of a stripe and serve as anodes. The scanning and signal electrodes ScE and SiE form together a P-type device.

The scanning electrode drive circuit 1 has select switches L ($L_1$, $L_2$, . . . , $L_y$) connected to the scanning electrodes ScE ($ScE_1$, $ScE_2$, . . . , $ScE_y$) as shown in FIG. 4. The scanning electrode drive circuit 1 determines to select or not the scanning electrodes ScE by turning on or off each select switch L by a control signal from a controller (not shown) and causes the selected scanning electrode ScE to have a GND potential.

On the other hand, the signal electrode drive circuit 2 comprises select switches S ($S_1$, $S_2$, . . . , $S_x$) connected to the signal electrodes SiE ($SiE_1$, $SiE_2$, . . . , $SiE_x$), current sources CS ($CS_1$, $CS_2$, . . . , $CS_x$) connected to the select switches S ($S_1$, $S_2$, . . . , $S_x$), and a power source 4 to feed each of the current sources CS. The power source 4 applies a voltage to the current sources CS which will provide a necessary current $I_0$ for allowing each display element to provide a sufficient light emission for display. In the signal electrode drive circuit 2, each select switch is turned on or off by a control signal from the controller (not shown) to determine to select or not the signal electrodes SiE and the current $I_0$ from the current sources CS is supplied as a display signal to the selected signal electrodes SiE.

Figure 5:
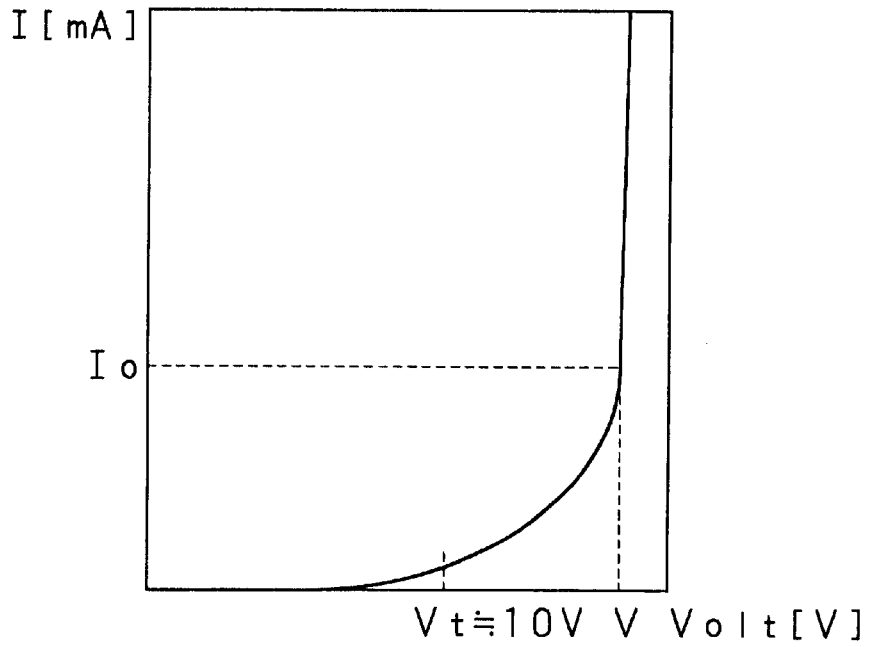
FIG. 5 is a voltage vs. current characteristic of an organic EL (electroluminescence) display element used as current-driven display element.

The current-driven display elements disposed at the intersections of the scanning and signal electrodes ScE and SiE are formed each from an organic electroluminescence (EL) display (referred to as "organic EL" hereinunder) which emits a green light. The voltage vs. current characteristic of the organic EL is shown in FIG. 5. As seen from FIG. 5, the organic EL driven by the matrix drive 10 has such characteristics as a threshold voltage Vt of about 10 V at which the light emission is started, a necessary current $I_0$ for sufficient light emission of 8 $mA/cm^2$, and a necessary output voltage V of 11 V of the power source 4 of the signal electrode drive circuit 2 for supply of the current $I_0$ to the current sources CS.

As shown in FIG. 4, the precharge circuit 3 comprises select switches $C_1$ to $C_x$ connected to the signal electrodes $SiE_1$ to $SiE_x$ respectively, and power sources 5 to supply powers to the signal electrodes SiE via the and the selected switches $C_1$ to $C_x$. The power sources 5 provide the signal electrodes $SiE_1$ to $SiE_x$ with the threshold voltage Vt at which the organic EL starts emitting light, via the selected switches $C_1$ to $C_x$. In FIG. 4, the power sources 5 are provided for the select switches $C_1$ to $C_x$, respectively, but one power source 5 may be provided to supply a power to each of the signal electrodes SiE via the selected switches $C_1$ to $C_x$.

The precharge circuit 3 is adapted to provide the threshold voltage Vt for the organic ELs for a stray capacitance developed at the intersections of the scanning and signal electrodes ScE and SiE in advance when selecting or not the scanning electrodes $ScE_1$ to $ScE_y$ by the select switches $L_1$ to $L_y$ of the scanning electrode drive circuit 1. More particularly, the precharge circuit 3 determines to provide or not the threshold voltage Vt to each of the signal electrodes SiE by turning on or off the select switches $C_1$ to $C_x$ by the control signal from the controller (not shown).

The matrix drive 10 constructed as described in the foregoing functions as will be described below with reference to FIG. 6:

First in the matrix drive 10, the scanning electrode drive circuit 1 selects the scanning elements ScE by the select switches $L_1$ to $L_y$. Thereafter the precharge circuit 3 turns on the selected switches $C_1$ to $C_x$ to precharge an electric charge for a period $T_1$ under the threshold voltage Vt from the power source 5 as shown in FIG. 6. In the matrix drive 10, this precharging permits to accumulate an electric charge for the stray capacitance developed at the intersections between the scanning and signal electrodes ScE and SiE, and charge up to the threshold voltage Vt for the organic EL.

After the precharging period $T_1$, the precharge circuit 3 turns off the select switches $C_1$ to $C_x$ and then the signal electrode drive circuit 2 turns on or off the selected switches $S_1$ to $S_x$ for the signal electrodes SiE to select or not each organic EL. At this time, when the select switches S are on, the output voltage V from the signal electrode drive circuit 2 is applied to a corresponding organic EL, so that the current 10 having been described with reference to FIG. 5 and so the organic ELs emit light after a period $T_0$ shown in FIG. 6. On the other hand, when the select switches S are off, the output voltage V from the signal electrode drive circuit 2 will not be applied to the corresponding organic ELs and the potential at the organic ELs remains as the threshold voltage Vt at the time of precharging, so that the organic ELs will not emit light. In the matrix drive 10, next scanning electrodes ScE are selected sequentially and similar operations are conducted to illuminate the organic ELs for display of an image or the like.

Figure 6:
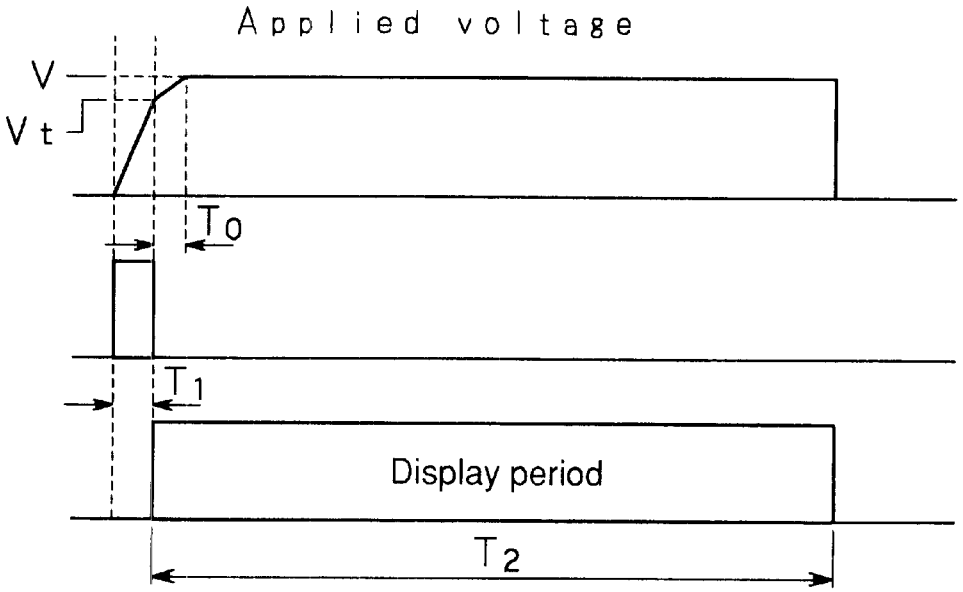
FIG. 6 is a functional timing chart showing the relationship between a precharging period and display period in one scanning time.

As shown in FIG. 6, since the voltage width V−Vt varying for the period $T_0$ is small, say, it can be made almost zero, the time taken for illumination of the organic ELs will be determined only by the precharging period $T_1$. Also, since the precharge voltage can be increased to shorten the precharging period $T_1$, it is possible to increase the ratio of a time $T_2$ for which the organic ELs are made to illuminate within one scanning time (display period) with the one scanning time as shown in FIG. 6. Thus, in the matrix drive 10, the number of gray scales is not limited or the gray scale level is not deteriorated as having been described with reference to FIG. 3, so that a display signal from the signal electrode drive circuit 2 can be reproduced with a high fidelity.

Figure 7:
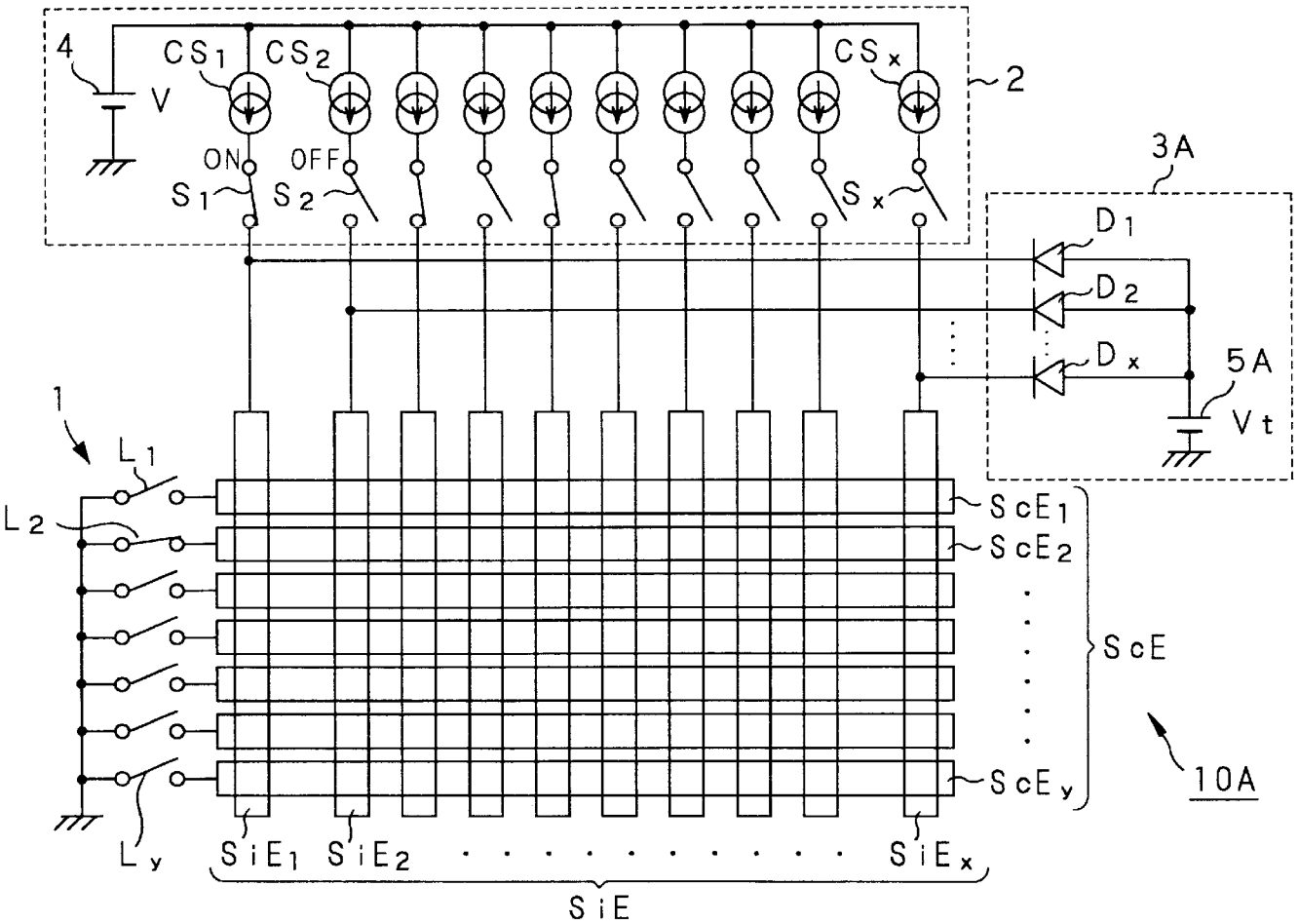
FIG. 7 is a schematic illustration of another embodiment of the current-driven display element matrix driving apparatus according to the present invention.

Referring now to FIG. 7, there is illustrated the second embodiment of the simple matrix driving apparatus for driving current-driven display elements (referred to simply as "matrix drive" hereinunder) according to the present invention. The matrix drive is generally indicated with a reference 10A. As seen, the matrix drive 10A in FIG. 7 is different in configuration of the precharge circuit from the matrix drive 10 in FIG. 4.

As shown in FIG. 7, the matrix drive 10A has a precharge circuit 3A comprising diodes $D_1$ to $D_x$ connected to the signal electrodes $SiE_1$ to $SiE_x$, respectively, and a power source 5A to supply a power to the signal electrodes SiE via the diodes $D_1$ to $D_x$. The power source 5A has a negative pole connected to a ground potential, and a positive pole connected to the diodes $D_1$ to $D_x$ to provide to the signal electrodes $SiE_1$ to $SiE_x$ via the diodes $D_1$ to $D_x$ a threshold voltage Vt at which the organic ELs start emitting light. The diodes $D_x$ to DX have anodes thereof connected to the signal electrodes $SiE_1$ to $SiE_x$ and cathodes thereof connected to a positive pole of the power source 5A which is thus protected. To protect each device, a current limiting resistor is connected between the diode and the power source 5A (Vt) as necessary in practice.

In the matrix driver 10A having the precharge circuit 3A, upon selection of scanning electrodes ScE by the select switches L of the scanning electrode drive circuit 1, the organic ELs on the selected scanning electrodes ScE are applied with the threshold voltage Vt from the power source 5A. Thus, in the matrix drive 10A, there is no changeover between the precharge and display period $T_2$, taking place by the select switches C of the precharge circuit 3 in the matrix drive 10 in FIG. 4. Therefore, the matrix drive 10A can allow the organic ELs to emit light more quickly.

Figure 8:
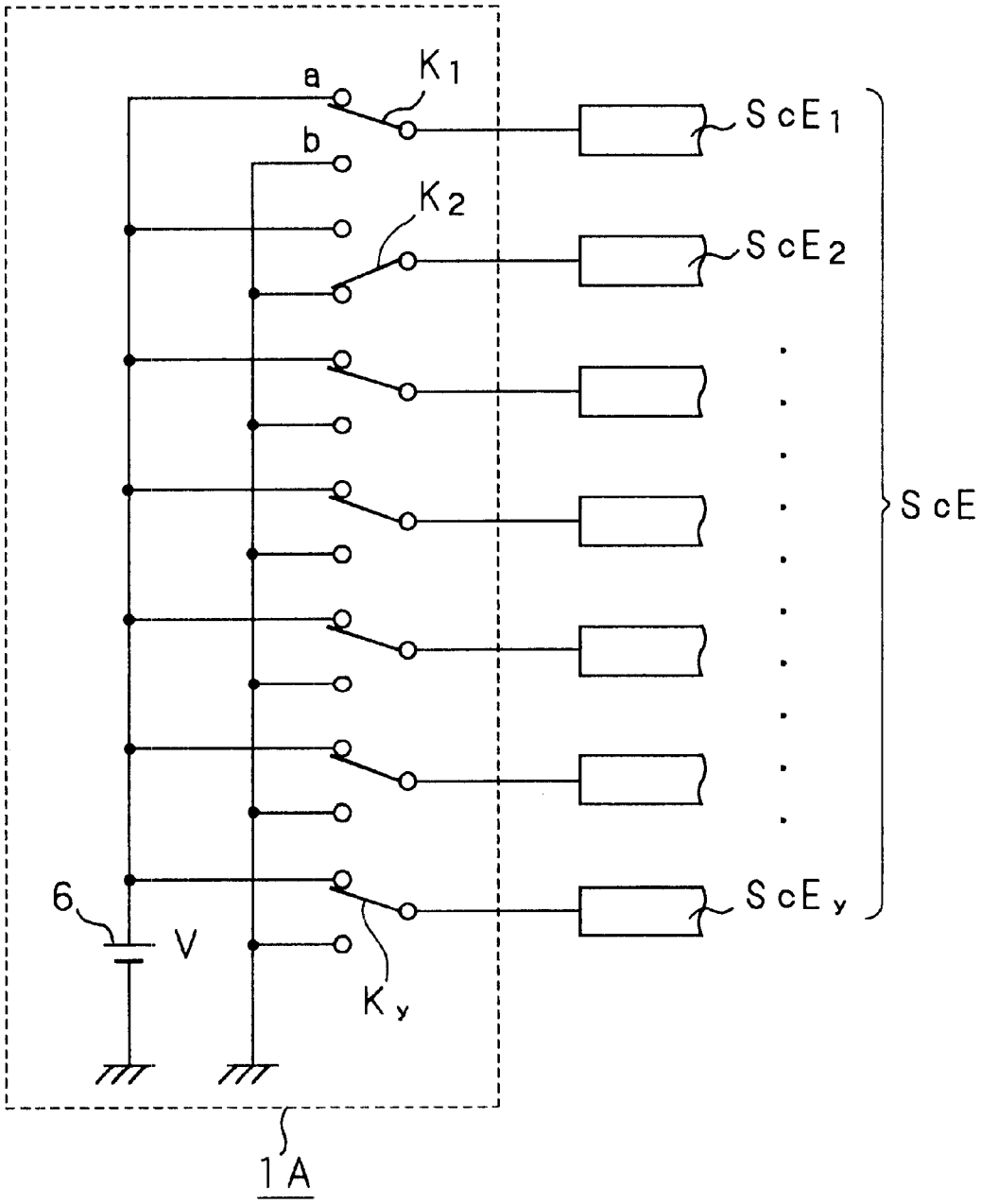
FIG. 8 shows an configuration of a scanning electrode drive circuit.

Referring now to FIG. 8, there is illustrated another configuration of the scanning electrode drive circuit. The scanning electrode drive circuit is generally indicated with a reference 1A. The scanning electrode drive circuit 1A comprises select switches K ($K_1$, $K_2$, . . . , $K_y$) connected to the scanning electrodes ScE ($ScE_1$, $ScE_2$, . . . , $ScE_y$) and a power source 6 to supply a power to the scanning electrodes ScE via the select switches K, respectively.

The scanning electrode drive circuit 1A has two terminals, that is, a non-selection terminal a and a selection terminal b provided for each of the select switches K connected to the scanning electrodes ScE, respectively. The select switch K is connected to either of these terminals a and b. In this scanning electrode drive circuit 1A, each non-selection terminal a is connected to the power source 6 and each selection terminal b is connected to the ground potential, as shown in FIG. 8. The power source 6 provides the scanning electrodes ScE with a potential V or a voltage higher than the potential V from the power source 4 at the signal electrodes SiE.

In the scanning electrode drive circuit 1A, each of the select switches K is connected to either the selection terminal a or non-selection terminal b by the control signal from the controller (not shown). Thus, the potential at the scanning electrode ScE selected by the select switch K has a GND level potential while the potential at the scanning electrode ScE not selected is V volts.

In these matrix drives 10 and 10A having the above-mentioned configurations, respectively, when the scanning electrode ScE is not selected, no current will flow to the corresponding organic EL, so that the influence of cross-talk will be reduced.

Figure 9:
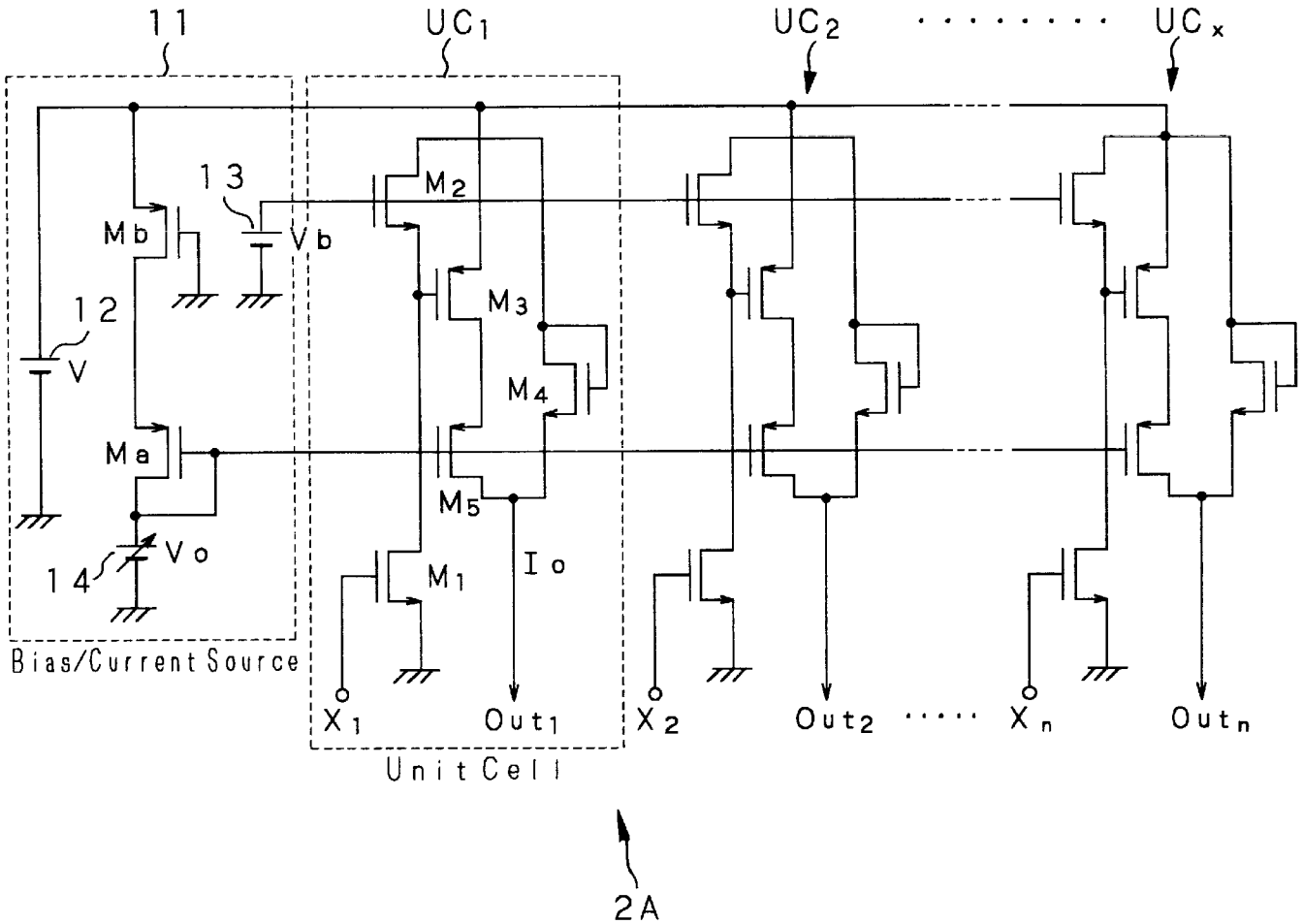
FIG. 9 is a circuit diagram of a signal electrode drive circuit formed from integrated circuits (IC).

Referring now to FIG. 9, there is illustrated a version of the signal electrode drive circuit 2 using integrated circuits. The signal electrode drive circuit using IC circuits is generally indicated with a reference 2A. The IC-type signal electrode drive circuit 2A comprises a voltage/current source 11 and unit cells UC ($UC_1$, $UC_2$, . . . , $UC_x$) connected to signal electrodes SiE, respectively. The voltage/current source 11 comprises a constant voltage source 12 to apply a constant voltage V to each of the unit cells UC, a constant voltage source 13 to apply a constant voltage Vb to each of the unit cells UC, a variable voltage source 14 to apply a variable voltage $V_0$ to each of the unit cells UC, and two P-type MOS transistors Ma and Mb. The MOS transistor Ma has a drain thereof connected to a positive pole of the variable voltage source 14 and a source connected to a drain of the MOS transistor Mb. The MOS transistor Ma has drains and gate thereof connected directly to each other.

As shown in FIG. 9, each unit cell UC is comprised of three N-type MOS transistors M1, M2 and M4 and two P-type MOS transistors M3 and M5. The MOS transistor M1 has a gate thereof connected to an input terminal X to which an input signal, 1 (high) or 0 (low), from an external block, a source connected to a ground potential, and a drain connected to a gate of the MOS transistor M3 and a source of the MOS transistor M2. The MOS transistor M2 has a gate thereof connected to the constant voltage source 13, a drain connected to a source of the MOS transistor M3 and to a drain and gate of the MOS transistor M4. The MOS transistor M3 has a drain thereof connected to a source of the MOS transistor M5. In each of the unit cells UC, the MOS transistor M5 has a drain thereof connected to a source of the MOS transistor M4. The above-mentioned current $I_0$ is provided as the display signal from this common junction.

The MOS transistor M4 is connected like a diode and can apply a voltage V to Out terminals of the signal electrode drive circuit 2A. Since the MOS transistors are limited in current by a resistance depending upon 1/gm (where gm is a mutual conductance), the size of the MOS transistor M4 is determined (i.e. a ratio between width W and length L is increased) for the current through the MOS transistor M4 to be as large as possible depending on the maximum allowable current of the device.

In the signal electrode drive circuit 2A, the MOS transistors Ma and Mb form together a current mirror, and the current 10 provided from the MOS transistors M5 and M4 in each unit cell UC (referred to as "display current $I_0$" hereinunder) is determined by adjusting the output voltage $V_0$ from the variable voltage source 14. The MOS transistors M1 and M2 form together an inverter. The MOS transistor M2 provides a bias voltage Vb and the MOS transistor M2 is a load resistance.

When the signal electrode drive circuit 2A is supplied at input terminals X thereof with an input signal "1" (high: display and current supply), the MOS transistor M1 is turned on, the MOS transistor M3 has a low level at the gate thereof, the MOS transistor M5 has at the source thereof a voltage V from the constant voltage source 12, and a same current as flowing through the MOS transistor Ma flows through the MOS transistor M5, thereby providing a display current $I_0$. At this time, the voltage drop (resistance) at the MOS transistor M3 is same as at the MOS transistor Mb.

On the other hand, when the signal electrode drive circuit 2A is supplied at the input terminal X thereof with an input signal "0" (low: no display and no current supply), the MOS transistor M1 is not turned on but it is connected to the constant voltage source 12 because of the resistance of 1/gm of the MOS transistor M2, the P-type MOS transistor M3 has a high level at the gate thereof and is turned off. Thus, the MOS transistor M5 is not applied with a bias voltage. In this case, a same current flowing through the MOS transistor Ma will flow through the MOS transistor M5, thereby providing no display current $I_0$.

When the signal electrode drive circuit 2A is supplied at the input terminals X of the unit cells UC with an input signal "1" (ON) or "0" (OFF), the signal electrodes $SiE_1$ to $SiE_x$ can be supplied or not with the display current $I_0$ from the unit cells UC.

According to the present invention, before a display signal is supplied to each signal electrode SiE, an electric charge is precharged for a stray capacitance developed at the intersections of the scanning and signal electrodes ScE and SiE, so that an efficient display can be done for one-scanning line selection time. Thus, the gray scale level deterioration caused by the stray capacitance of a simple matrix-type current-driven display device can considerably be reduced. For the precharging, either the precharge circuit 3 formed from the select switches C or the precharge circuit 3A formed from the diodes D, can prevent the gray scale level deterioration with a same effectiveness. For forming the circuit from integrated circuits, the precharge circuit 3A can more easily be implemented.

The aforementioned embodiments of the present invention adopt a P-type electrode configuration in which the signal electrodes SiE are transparent anodes while the scanning electrodes ScE are cathodes made of a metal. However, the present invention is not limited only to this P-type electrode configuration. The present invention can be implemented by adopting an N-type electrode configuration in which the scanning electrodes ScE are anodes while the signal electrodes are cathodes. In this case, however, the transparent signal electrodes SiE should have a low resistance. By adopting the N-type electrode configuration, the power consumption can be small.

As having been described in the foregoing, in the matrix driving method for the current-driven display elements according to the present invention, an electric charge is precharged for the capacity at the intersections of the scanning and signal electrodes before the display signal is supplied to the signal electrodes, thereby accumulating an electric charge for the stray capacitance developed at the intersections. Thus an efficient display can be attained for the one-scanning line selection period, so that the image quality deterioration due to the stray capacitance is greatly suppressed.

In the matrix driving apparatus for the current-driven display elements according to the present invention, an electric charge is precharged for the capacity at the intersections of the scanning and signal electrodes before the display signal is supplied to the signal electrodes, thereby accumulating an electric charge for the stray capacitance developed at the intersections. Thus, an efficient display can be attained for the one-scanning line selection period, so that the image quality deterioration due to the stray capacitance is greatly suppressed.

What is claimed is:

1. A matrix driving method for current-drive display elements, in which current-driven display elements are disposed, in a matrix fashion, at intersections of a plurality of scanning electrodes and a plurality of signal electrodes, a scanning electrode is selected and a display signal is supplied to each signal electrode to drive each of the current-driven display elements comprising:

forming the scanning electrodes in a stripe pattern;

forming the signal electrodes in a stripe pattern;

forming a scanning electrode driver circuit with select switches connected to each scanning electrode;

forming a signal electrode driver circuit with select switches connected to each signal electrode;

precharging an electric charge to a capacity of the intersection with a threshold voltage; before supplying the display signal to the signal electrode according to the scanning electrode driver circuit.

2. The method as set forth in claim 1, wherein before the display signal is supplied to the signal electrode, a ground level potential is applied to the selected scanning electrode while a potential higher than that applied to the signal electrode is applied to the non-selected scanning electrode.

3. The matrix driving method of claim 1, wherein said precharging step occurs according to data supplied from said signal electrode driver circuit.

4. A matrix driving apparatus for current-driven display elements, in which current-driven display elements are disposed, in a matrix fashion, at intersections of a plurality of scanning electrodes and a plurality of signal electrodes, a scanning electrode is selected and a display signal is supplied to each signal electrode to drive each of the current-driven display elements, the matrix driving apparatus comprising:

the scanning electrodes being formed in a stripe pattern;

the signal electrodes also being formed in a stripe pattern;

means for separately precharging an electric charge to each of a capacity of the intersections with a threshold voltage before the display signal is supplied to the signal electrode; and a scanning electrode driver circuit comprising select switches connected to each scanning electrode, for determining whether or not to supply said display signal.

5. The apparatus as set forth in claim 4, wherein the scanning electrode driving means applies a ground level potential to the scanning electrode selected by the scanning electrode selecting means while it applies the non-selected scanning electrode with a potential higher than that applied to the signal electrode.

6. The apparatus as set forth in claim 4, wherein the signal electrode selecting means is formed from an MOS transistor.

7. The matrix driving apparatus of claim 4, wherein said scanning electrode drive circuit has both selection and a non-selection terminals for each of said intersections, so that while in non-selection mode, cross-talk is reduced.

8. The matrix driving apparatus of claim 4, wherein said signal electrode drive circuit comprises a plurality of voltage/current sources and unit cells, each of which are connected to one of said signal electrodes;

said voltage/current sources each comprising a constant voltage source, a variable voltage source, and two P-type MOS;

said unit cells comprising three N-type MOS transistors and two P-type MOS transistors;

wherein said MOS transistors act to reduce stray capacitance, thereby reducing visible gray-scale deterioration.

* * * * *